United States Patent [19]

McIntyre

[11] Patent Number: 4,747,522

[45] Date of Patent: May 31, 1988

[54] FLUID DISPENSING DEVICE

[76] Inventor: Phillip McIntyre, P.O. Box 353, Titusville, N.J. 08560

[21] Appl. No.: 33,956

[22] Filed: Apr. 3, 1987

[51] Int. Cl.[4] ..... B65D 37/00

[52] U.S. Cl. ..... 222/213; 222/496

[58] Field of Search ..... 222/491, 496, 497, 494, 222/206, 213, 495, 525, 522, 559, 519, 511, 513

[56] References Cited

U.S. PATENT DOCUMENTS

| | | | |
|---|---|---|---|
| 2,080,427 | 5/1937 | McLaughlin | 222/496 |
| 2,168,297 | 8/1939 | Voke | 222/496 |
| 2,772,817 | 12/1956 | Jauch | 222/213 |

FOREIGN PATENT DOCUMENTS

| | | | |
|---|---|---|---|
| 2006948 | 2/1971 | Fed. Rep. of Germany | 222/497 |
| 627319 | 6/1927 | France | 222/496 |
| 724798 | 2/1955 | United Kingdom | 222/496 |

*Primary Examiner*—H. Grant Skaggs
*Assistant Examiner*—Kenneth Noland
*Attorney, Agent, or Firm*—Sperry, Zoda & Kane

[57] ABSTRACT

A fluid dispensing device having a container with a collapsible body section and an upper neck which is adapted to receive therein a dispensing head which is automatically self-closing. The dispensing head has a housing defining a dispensing channel vertically therethrough in which a valve is positioned having a valve head for abutting a valve seat defined in the upper portion of the dispensing channel and a valve stem extending downwardly to a valve flange. A resilient member is secured to the upper face of the valve flange and in contact with the bottom surface of the housing to urge the valve into a closed position. The spring is positioned outwardly from the valve stem and exerts bias at multiple exterior points about the valve flange to create a completely equal and upwardly directed bias in order to maintain smooth operation of movement of the valve between an open and a closed position. Fluid flow holes are defined in the flange to facilitate the flow of fluid out the annular dispensing channel defined between the external diameter of the valve stem and the internal diameter of the dispensing channel. A one-way check valve is located in the housing of the dispensing head or the container to facilitate the flow of air from the external environment. The valve flange can include a plurality of individual struts in a wheel-like configuration.

16 Claims, 1 Drawing Sheet

FLUID DISPENSING DEVICE

BACKGROUND OF THE INVENTION

1. Field of the Invention

The present invention seals with the field of devices for dispensing various fluids normally of rather thick consistency such as ketchup, mustard, salad dressing and the like. Most prior art devices require a separate movement of a switch in the cap between an open and a closed position in order to allow for dispensing of such fluids.

The present invention seals with the field of devices which are however automatically closing that is after dispensing of the fluid, the dispensing opening is automatically shut to facilitate usage in high trafficing areas such as restaurants and the like.

2. Description of the Prior Art

Prior art devices have been patented on automatic closing devices having different structure from the disclosure of the present invention. In particular, U.S. Pat. No. 1,860,318 issued May 24, 1932 on a Collapsible Tube Closure patented to H. C. Keebler; U.S. Pat. No. 1,897,276 issued Feb. 14, 1933 on a Self Sealing Paste Tube patented to W. Petersen; U.S. Pat. No. 1,922,204 issued Aug. 15, 1933 on a Closure for Collapsible Tubes patented to C. W. Johnson; U.S. Pat. No. 1,982,294 issued November 27, 1934 on an Automatic Seal For Tubes patented to G. T. Griffin; U.S. Pat. No. 2,080,427 issued May 18, 1937 on a Closure For Collapsible Tubes and Containers patented to F. McLaughlin; U.S. Pat. No. 3,008,611 issued Nov. 14, 1961 on a Sealing and Dispensing Device patented to J. J. Mancusi, Jr.; U.S. Pat. No. 3,438,554 issued Apr. 15, 1969 on an Anti-Suck-Back Device For Tubes patented to G. Schwartzman; U.S. Pat. No. 3,490,658 issued Jan. 20, 1970 on an Aerosol Product Residue Eliminator patented to G. Schwartzman; U.S. Pat. No. 3,506,162 issued Apr. 14, 1970 on a Spray Applicator patented to G. Schwartzman; U.S. Pat. No. 3,658,216 issued Apr. 25, 1972 on a Metering and Discharge Device patented to G. Schwartzman; U.S. Pat. No. 3,705,668 issued Dec. 5, 1972 on a Dispenser With Dip Tube patented to G. Schwartzman; and U.S. Pat. No. 3,874,563 issued Apr. 1, 1975 on an Applicator Having Multiple Valve Assemblies patented to G. Schwartzman.

SUMMARY OF THE INVENTION

The present invention provides a fluid dispensing device having a container means with a body section adapted to receive and retain fluid therein for dispensing. The body section defines a fluid chamber therein for holding the undispensed fluid. Furthermore, the container means includes an upper neck section which defines an outlet therein at the uppermost portion of the body section which is adapted to receive the dispensing head.

The dispensing head is automatically self-closing and includes a housing member which is mounted in the outlet of the upper neck section and defines a dispensing channel extending vertically upwardly therethrough. The housing defines a valve seat adjacent to the uppermost end of the dispensing channel. The housing member also defines an abutment shoulder adjacent to the lower edge of the dispensing channel for receiving the upper end of a spring or other biasing means thereagainst. This abutment shoulder is referred to as the first abutment shoulder.

A valve is movably positioned in the housing and is mounted extending vertically through the dispensing channel. The valve is adapted to move between an open and a closed position as desired in order to control fluid flow communication between the fluid chamber and the external environment. Movement to the closed position is automatic upon release of the fluid dispensing device whereas movement to the open position is urged by the user exerting pressure on the exterior portion of the body section.

The valve means includes a valve head which is capable of abutment with respect to the valve seat to close the valve means and prevent fluid flow communication between the external environment when the valve is in the closed position. The valve head is also capable of movement away from the valve seat to thereby allow fluid flow communication between the fluid chamber and the external environment when the valve means is in the opened position to facilitate the controlled dispensing of fluid from the chamber.

A valve stem extends from a position adajcent and preferably integral with the valve head downwardly through to a position below the dispensing channel. The valve stem has an external diameter which is less than the internal diameter of the dispensing channel in such a manner as to define a dispensing conduit which is annular.

A valve flange is mounted on the valve stem at a position below the dispensing channel and generally extends horizontal and outwardly therefrom to define a second abutment shoulder facing upwardly in a position immediately below the first abutment shoulder defined in the housing member. A biasing member such as a spring or other resilient member is then mounted below the first abutment shoulder of the housing and above the second abutment shoulder of the valve flange and is spaced outwardly from the valve stem in order to exert a laterally equal bias on the valve head in a downwardly direction. In this manner, the biasing means will urge complete and equal abutment of the valve head with respect to the valve seat for closing of the valve means when in a steady state condition resulting from release of the container by a user.

Preferably the valve flange defines a plurality of fluid flow holes therein to facilitate the flow of fluid by the valve flange to a position adjacent to the lower end of the dispensing channel to aid in dispensing thereof. This is particularly useful with the thicker types of fluids which will be dispensed such as ketchup and mustard. Furthermore, in order to equalize pressure between the external environment and the fluid chamber, a one-way check valve means may be positioned in the housing member or in the body section of the container such that after fluid is dispensed and the valve automatically closes, air will be allowed to travel in one direction only which is inwardly into the fluid chamber to raise the air pressure therein to a point equal with the surrounding ambient air pressure.

In an alternative construction, the valve flange itself may comprise a plurality of individual strut means extending from a central member. These struts will extend radially outwardly from the central member to define the second abutment shoulder at the radially uppermost upwardly facing ends of the struts. In this configuration, the biasing means such as a plurality of individual springs will be positioned on these radially outermost upwardly facing ends which will comprise the second abutment shoulder and the springs will extend upwardly into abutting contact with the first abutment shoulder on the bottom portion of the housing. Preferably there will be at least three of such strut means in this alternative configuration.

In another alternative configuration, the valve flange itself will be in the conventional disc-shaped configuration however, the biasing means will comprise an O-ring of resilient material such as rubber in order to exert a completely equal and circumferential bias to urge the first and second abutment shoulders to separate and close the valve when in the steady state condition.

It is an object of the present invention to provide a fluid dispensing device wherein automatic closing is provided for dispensing of fluids.

It is an object of the present invention to provide a fluid dispensing device wherein the dispensing of thicker fluids such as mustard, ketchup and salad dressing is facilitated.

It is an object of the present invention to provide a fluid dispensing device wherein cost is minimized.

It is an object of the present invention to provide a fluid dispensing device wherein maintenance expenses and efforts are minimal.

It is an object of the present invention to provide a fluid dispensing device wherein very few moving parts are involved to facilitate control of dispensing.

It is an object of the present invention to provide a fluid dispensing device wherein low pressure internal conditions generated by actual dispensing will be alievated due to an internally directed one-way check valve.

It is an object of the present invention to provide a fluid dispensing device wherein a completely equal circumferential pressure is exerted to maintain alignment between the movable valve and the fluid dispensing conduit selectively closed thereby.

It is an object of the present invention to provide a fluid dispensing device wherein alternative configurations of the valve can be utilized depending on the type of fluid being dispensed.

It is an object of the present invention to provide a fluid dispensing device wherein a single dispensing head can be utilized with a variety of different types of containers.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
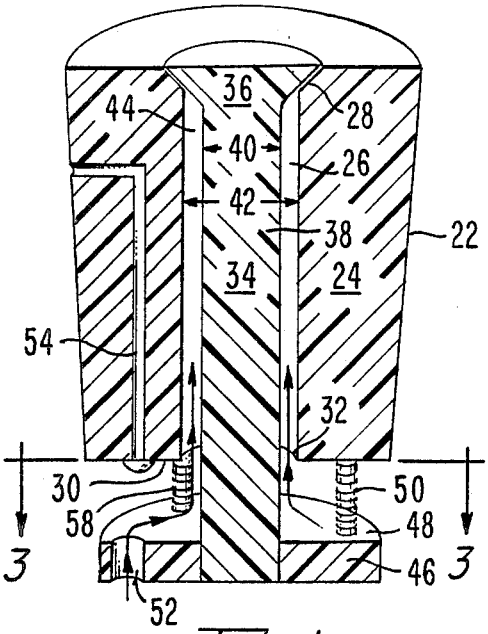
FIG. 1 is a cross sectional view of an embodiment of the dispensing head of the fluid dispensing device of the present invention shown in the closed position.
Figure 2:
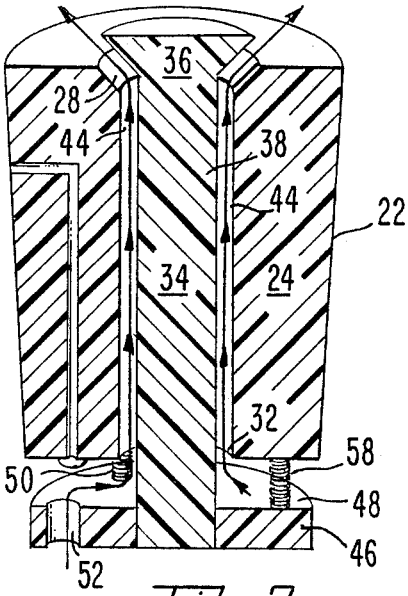
FIG. 2 is a view of the configuration shown in FIG. 1 in the opened position.

The present invention provides a fluid dispensing device having a container means 10 with an upper neck section 12 defining an outlet 14 therein. The container also includes a body section 16 which may be collapsible and defines therein a fluid chamber 20 to contain the dispensing fluid 18 therein. Preferably the body section 16 being collapsible is capable of resilient collapsing allowing it to return to the original shape after pressure is exerted thereon by the user for dispensing.

A dispensing head 22 is preferably positioned in the outlet 14 defined in upper neck section 12 in such a manner as to control the dispensing of fluid 18 from fluid chamber 20. Dispensing head 22 preferably includes a housing member 24 defining a dispensing channel 26 extending vertically therethrough. A valve seat 28 is also defined in the housing member 24 immediately adjacent to the upper end of the dispensing channel 26. This valve seat 28 is capable of being contacted by a valve to selectively open or close the fluid dispensing device of the present invention to effect dispensing or to prevent dispensing.

The housing member 24 preferably includes a first abutment shoulder 30 at the lower portion thereof to provide a surface against which a biasing means can exert pressure. This first abutment shoulder is preferably located spaced somewhat outwardly from the lower end 32 of the dispensing channel in order to allow an equal circumferential pressure to be exerted thereagainst.

A valve means 34 is defined positioned movably within the dispensing channel 26. Valve means 34 preferably includes a valve head 36 at the upper portion thereof and a valve stem 38 integral therewith and extending downwardly therefrom to a point below the lower end 32 of the dispensing channel 26. The valve head 36 is selectively capable of abutment with respect to valve seat 28 to allow for opening or closing of the fluid dispensing device. Valve stem 38 has an external diameter 40 which is less than the internal diameter 42 of dispensing channel 26. In this manner, an annular dispensing conduit 44 is defined therebetween. With the equal circumferential bias being exerted by the biasing means of the present invention, the orientation of the valve stem with respect to the dispensing channel will be maintained in order to more equally and carefully define the actual shape of the annular dispensing conduit 44 and facilitate movability of the valve means 34 between the opened and closed position.

A valve flange 46 is preferably located at the bottommost portion of the valve stem 38 and extends outwardly generally horizontally therefrom. Valve flange 46 therefore is movable with the valve head 36 and valve stem 38 as the valve means 34 moves between the opened and closed position. Valve flange 46 will present a second abutment shoulder 48 facing upwardly therefrom which is adapted to receive the bottom portion of a biasing means 50. Biasing means 50 will preferably be positioned between the second abutment shoulder 48 and the first abutment shoulder 30 in order to exert bias therebetween to urge those two shoulders away from one another. In this manner the valve flange 46 will have the steady state position exerted downwardly and the valve means 34 will assume the closed position without any other external pressure being exerted thereon. This closed position thereby will be the steady state position for the valve means 34.

Figure 4:
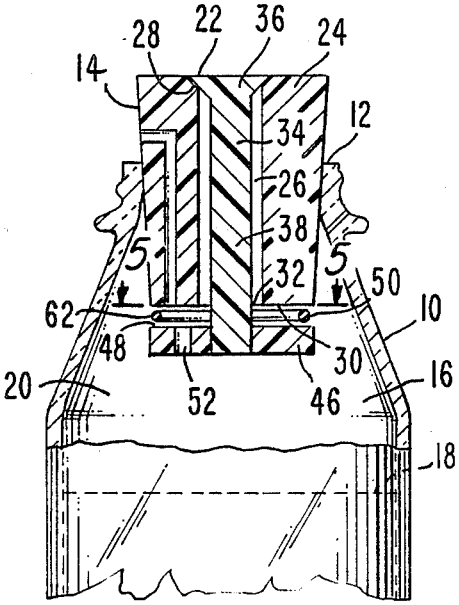
FIG. 4 is a cross sectional view of an alternative embodiment of the fluid dispensing device of the present invention.
Figure 7:
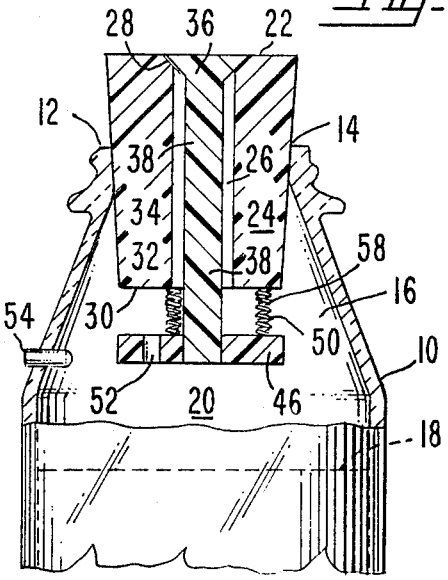
FIG. 7 is a side cross sectional view of an alternative embodiment of the fluid dispensing device of the present invention.
Figure 5:
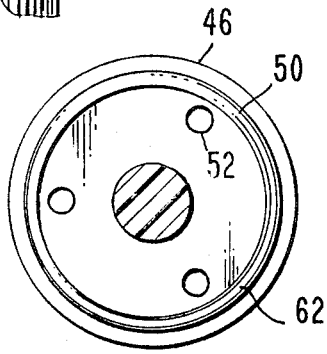
FIG. 5 is a top plan view of an alternative embodiment of the biasing means of the present invention.
Figure 3:
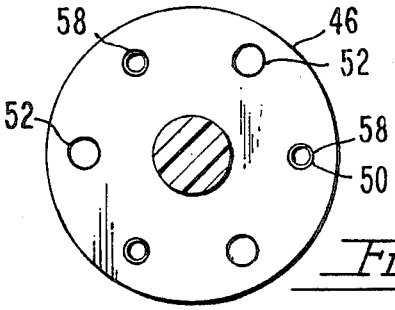
FIG. 3 is a top plan view of an embodiment of the valve flange of the present invention.

In order to facilitate the flow of fluid to the lower end 32 of the dispensing channel, a plurality of fluid flow holes 52 may be defined in the valve flange 46. These fluid flow holes become extremely important when the biasing means takes the form of an O-ring 62 as shown in FIGS. 4 and 5. The O-ring 62 preferably of a rubber or other resilient material, will exert a completely equal bias between the first abutment shoulder 30 and the second abutment shoulder 48 in such a manner as to maintain the orientation between valve stem 38 and the dispensing channel 26. However, the flow of fluid to the annular dispensing conduit 44 will be somewhat inhibited therefore, the use of fluid flow holes 52 defined extending vertically through the valve flange 46 will be made necessary. Another configuration of the biasing means 50 would be the use of springs 58 as shown in the other figures. With the use of at least three such springs positioned radially outwardly about the circumference or outermost portions of the valve flange 46, the pressure of the biasing means will be exerted in a circumferentially equal manner.

Figure 6:
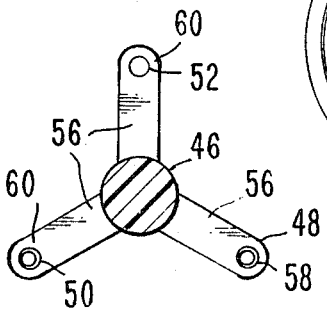
FIG. 6 is a top plan view of an alternative embodiment of the valve flange means of the present invention.

An alternative configuration for the valve flange 46 is shown in FIG. 6 which includes a plurality of individual strut means 56. These individual struts extend radially outwardly from a central position to present the second abutment shoulder 48 at the outermost upwardly facing ends 60 thereof. The springs 58 or other biasing means will be positioned at the ends 60 to provide an equal circumferential force tending to close valve means 34. With this configuration, a flow of fluid 18 to the dispensing channel 26 will be greatly enhanced due to the wide open areas between the the individual strut means 56.

After dispensing, the body section 16 will be somewhat compressed inwardly and upon release the valve means 34 will immediately close. In order to insure that the body section 16 can return to the normal uncompressed configuration, preferably the present invention will include a one-way check valve means 54 which allows the movement of air from the external environment inwardly into the fluid chamber but prevents any fluid flow outwardly whatsoever. This valve 54 can be positioned in the housing member 24 of the dispensing head 22 or can be positioned directly in the body section 16 of container means 10. In either configuration, the control of internal pressure within fluid chamber 20 is fully achieved.

In operation of the present invention, when dispensing is desired the user will compress body section 16 of container 10. This compression will exert an increased internal pressure. Normally the user will invert the fluid dispensing device such that the fluid 18 can be dispensed as adjacent to the dispensing head 22.

When the user compresses body section 16 which is preferably of a plastic material, it will be distended somewhat inwardly thereby increasing internal pressure within fluid chamber 20. This increased pressure will be exerted upon the valve head 36 of valve 34 in such a manner as to eventually overcome the pressure being exerted downwardly by biasing means 50. In this manner, fluid will be allowed to travel past the flange 46 into the dispensing channel 26 and along the annular dispensing conduit 44. The fluid will travel further along the valve stem 38 and outwardly between the valve head 36 and the valve seat 28. In this manner, fluid 18 can be controlled when dispensed.

Once the user has dispensed the desired amount of fluid, the body section 16 will be released. In this manner the pressure exerted against the valve head 36 will be eliminated and the resilient biasing means 50 will return the valve to the closed position. Furthermore, in order to allow the body section 16 to return to the normal configuration, the check valve means 54 will admit air inwardly from the surrounding environment into the fluid chamber 20 until the body section 16 has been allowed to assume the normal steady state shape and the pressure inside the fluid chamber 20 has returned to the external atmospheric pressure.

The present invention is particularly novel in view of the circumferential manner in which the biasing means exerts force between the movable valve means and the dispenser housing. This circumferentially exerted force maintains accurate orientation between the valve stem 34 and the dispensing channel 26 in order to accurately define the annular dispensing conduit 44.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A fluid dispensing device comprising:

(a) a container means comprising:

(1) an upper neck section defining an outlet therein at the uppermost end thereof;

(2) a body section adapted to receive and retain fluid therein for dispensing thereof, said body section defining a fluid chamber therein for holding undispensed fluid, (b) a dispensing head being automatically self-closing and comprising:

(1) a housing member mounted in said outlet of said upper neck section and defining a dispensing channel extending vertically upwardly therethrough, said housing defining a valve seat adjacent to the uppermost end of said dispensing channel, said housing member including a first abutment shoulder adjacent to the lower end of said dispensing channel;

(2) a valve means movably secured to said housing member and mounted extending vertically through said dispensing channel, said valve means being adapted to selectively move between an open and a closed position to control fluid flow communication between said fluid chamber and the external environment, said valve means including:

a. a valve head selectively engageable with respect to said valve seat to close said valve means and prevent fluid flow communication between said fluid chamber and the external environment when said valve means is in the closed position, said valve head also being selectively disengageable with respect to said valve seat to allow fluid flow communication between said fluid chamber and the external environment when said valve means is in the opened position to facilitate controlled dispensing of fluid from said fluid chamber;

b. a valve stem extending from adjacent said valve head downwardly through and below said dispensing channel, said valve stem having an external diameter less than the internal diameter of said dispensing channel to define an annular dispensing conduit therebetween;

c. a valve flange mounted on said valve stem at a position below said dispensing channel, said valve flange comprising a plurality of individual strut means extending radially horizontally outwardly from said valve stem to define a second abutment shoulder at the radially outermost upwardly facing ends thereof and facing upwardly below said housing member; and d. a biasing means including a plurality of individual spring means each abutting the radially outermost upwardly facing ends of said strut means and extending upwardly to said first abutment shoulder to exert bias thereagainst, said individual spring means being mounted below said first abutment shoulder of said housing member and above said second abutment shoulder of said valve flange and spaced outwardly from said valve stem to exert a laterally equal bias on said valve flange and said valve head downwardly with respect to said housing member to urge complete and equal abutment of said valve head with respect to said valve seat for closing of said valve means in the steady state condition.

2. The fluid dispensing device as defined in claim 1 wherein said valve flange defines a plurality of fluid flow holes therein to facilitate the flow of fluid by said valve flange to a position adjacent the lower end of said dispensing channel to aid in dispensing thereof.

3. The fluid dispensing device as defined in claim 1 further including a one-way valve means positioned in said housing member of said dispensing head to provide one-way fluid flow communication from the external environment into said fluid chamber to allow the pressure therein to equalize with the atmospheric pressure after dispensing of fluid therefrom.

4. The fluid dispensing device as defined in claim 3 wherein said one-way valve means comprises a check valve means.

5. The fluid dispensing device as defined in claim 1 further including a one-way valve means positioned in said container means to provide one-way fluid flow communication from the external environment into said fluid chamber to allow the pressure therein to equalize with the atmospheric pressure after dispensing of fluid therefrom.

6. The fluid dispensing device as defined in claim 5 wherein said one-way valve means comprises a check valve means.

7. The fluid dispensing device as defined in claim 1 wherein said valve flange includes at least three of said strut means.

8. The fluid dispensing device as defined in claim 1 wherein said biasing means comprises an O-ring of resilient material to facilitate laterally equal biasing of said valve means with respect to said dispensing channel to maintain the symmetrical shape of said annular dispensing conduit.

9. The fluid dispensing device as defined in claim 1 wherein said body section of said container means is resiliently collapsible to facilitate dispensing of fluid from said fluid chamber defined therein.

10. The fluid dispensing device as defined in claim 1 wherein said valve seat and said valve head of said valve means are flared outwardly and upwardly from said dispensing channel to facilitate control of fluid dispensing.

11. The fluid dispensing device as defined in claim 1 wherein said valve flange is mounted on said valve stem at the lowermost end thereof.

12. The fluid dispensing device as defined in claim 1 wherein said valve head, said valve stem and said valve flange of said valve means comprise one integrally formed unit.

13. The fluid dispensing device as defined in claim 1 wherein said container means is made from resiliently collapsible plastic.

14. A fluid dispensing device comprising:

(a) a container means comprising:

(1) an upper neck section defining an outlet therein at the uppermost end thereof;

(2) a resiliently compressible plastic body section adapted to receive and retain fluid therein for dispensing thereof, said body section defining a fluid chamber therein for holding undispensed fluid;

(b) a dispensing head being automatically self-closing and comprising:

(1) a housing member mounted in said outlet of said upper neck section and defining a dispensing channel extending vertically upwardly therethrough, said housing defining a valve seat adjacent to the uppermost end of said dispensing channel and extending upwardly and outwardly therefrom, said housing member including a first abutment shoulder adjacent to the lower end of said dispensing channel;

(2) a valve means movably secured to said housing member and mounted extending vertically through said dispensing channel, said valve means being adapted to selectively move between an open and a closed position to control fluid flow communication between said fluid chamber and the external environment, said valve means including:

a. a valve head extending upwardly and outwardly with respect to said dispensing channel and being selectively enageable with respect to said valve seat to close said valve means and prevent fluid flow communication between said fluid chamber and the external environment when said valve means is in the closed position, said valve head also being selectively disengageable with respect to said valve seat to allow fluid flow communication between said fluid chamber and the external environment when said valve means is in the opened position to facilitate controlled dispensing of fluid from said fluid chamber;

b. a valve stem being integral with respect to said valve head extending downwardly therefrom to a position below said dispensing channel, said valve stem having an external diameter less than the internal diameter of said dispensing channel to define an annular dispensing conduit therebetween;

c. a valve flange being integral with respect to said valve head and said valve stem and located at the lowermost section of said valve stem below said dispensing channel, said valve flange comprising a plurality of individual strut means extending radially horizontally outwardly from said valve stem to define a second abutment shoulder at the radially outermost upwardly facing ends thereof and facing upwardly below said housing member, said valve flange defining a plurality of fluid flow holes therein between said individual strut means to facilitate the flow of fluid by said valve flange to a position adjacent the lower end of said dispensing channel to aid in dispensing thereof;

d. a biasing means including a plurality of individual spring means each abutting the radially outermost upwardly facing ends of said strut means and extending upwardly to said first abutment shoulder to exert bias thereagainst, said individual spring means being mounted below said first abutment shoulder of said housing member and above said second abutment shoulder of said valve flange and spaced outwardly from said valve stem to exert a laterally equal bias on said valve flange and said valve head downwardly with respect to said housing member to urge complete and equal abutment of said valve head with respect to said valve seat for closing of said valve means in the steady state condition, said biasing means comprising a plurality of individual spring means positioned between said first abutment shoulder and said second abutment shoulder; and (c) a one-way check valve means providing one-way fluid flow communication from the external environment into said fluid chamber to allow the pressure therein to equalize with the atmospheric pressure after dispensing of fluid therefrom.

15. The fluid dispensing device as defined in claim 14 wherein said one-way check valve means is positioned extending through said housing member of said dispensing head.

16. The fluid dispensing device as defined in claim 14 wherein said one-way check valve means is positioned extending through said body section of said container means.

* * * * *